73-151 SR
1/5/88 XR 4,717,473

United States Patent [19]
Burge et al.

[11] Patent Number: 4,717,473
[45] Date of Patent: Jan. 5, 1988

[54] APPARATUS FOR TIME-AVERAGED OR COMPOSITE SAMPLING OF CHEMICALS IN GROUND WATER

[76] Inventors: Scott R. Burge, 999 E. Baseline #3111, Tempe, Ariz. 85283; Russell Burge, 21140 Covina Hills Rd., Covina, Calif. 91724

[21] Appl. No.: 4,872

[22] Filed: Jan. 20, 1987

[51] Int. Cl.[4] ..... E21B 47/00; E21B 33/127; E21B 23/06; B01D 17/12

[52] U.S. Cl. ..... 210/170; 210/198.2; 210/541; 166/147; 166/163; 166/168; 166/187; 166/264; 73/151

[58] Field of Search ..... 210/198.2, 263, 170, 210/656, 660, 541, 542; 166/147, 163, 167, 168, 191, 264, 187; 73/151, 864

[56] References Cited

U.S. PATENT DOCUMENTS

| | | | |
|---|---|---|---|
| 3,529,665 | 9/1970 | Malone | 166/264 |
| 4,013,124 | 3/1977 | Hutchinson et al. | 73/151 |
| 4,438,654 | 3/1984 | Torstensson | 166/264 |
| 4,448,692 | 5/1984 | Nakamoto et al. | 210/198.2 |
| 4,483,187 | 11/1984 | Maddock, Jr. | 73/151 |
| 4,635,717 | 1/1987 | Jageler | 166/264 |

*Primary Examiner*—Richard V. Fisher
*Assistant Examiner*—Richard D. Jordan

[57] ABSTRACT

The ground-water sampler collects a time-averaged or composite sample of the ground water. The sampling system was designed to be self-contained and all sources of power being contained within the well casing. The sampler collects the sample on a sorptive media and the media analyzed by a laboratory. The sampling system prevents the exchange of gases between the ground water and the atmosphere. The exchange is prevented by a well packer which is designed to be placed in well casings of 2 inches or greater. The well packer can be easily and economically placed into the well casing with the use of a packer tool. The sampler is inserted into the well packer and once inserted a one-way check valve opens to the aquifer allowing the water to be sampled. After the sampling episode, the sampler is removed from the well packer and the one-way check valve closes. The media is then analyzed in a laboratory. In the alternative, the sorptive media unit can be replaced with chemical or physical analysis units making possible real-time analysis of the aquifer.

4 Claims, 8 Drawing Figures

APPARATUS FOR TIME-AVERAGED OR COMPOSITE SAMPLING OF CHEMICALS IN GROUND WATER

BACKGROUND

1. Field of Invention

This invention is for sampling chemical and biological parameters in ground-water wells, specifically the apparatus collects a time-averaged or composite sample and makes possible real-time analyses.

2. Discussion of Prior Art A search of the literature has indicated that no invention exists for sampling ground water which combines a pumping apparatus, sorption unit and packer. A literature search has shown an invention which combines a pumping apparatus with a sorption unit (Manual of Ground-Water Quality Sampling Procedures, U.S. Environmental Protection Agency, Ada, Okla. 1981). This invention positions the pumping apparatus at the bottom of the well casing and the sorption columns at the surface. This configuration requires a powerful pump to lift the water to the surface and a tube connecting the pump with the sorption columns. The apparatus does not address some of the problems which my invention was designed to correct. The main differences are: (1) the earlier invention does not include a packer which is used to isolate the ground water from the atmosphere, (2) the earlier invention requires the sorption tube to be located above the pumping apparatus which introduces errors in sampling trace organics and metals because of pressure and temperature differentials, sorption of the sample on the connecting tube and other losses which can occur when the sample is altered during the sampling process. Additionally, the configuration of the earlier sampler is not amenable to remote sampling locations because of the power and security problems.

A tube and cartridge method was used in a ground-water investigation by Pankow et al. (Ground Water, Vol.23, No.6, November-December 1985). The sampler consisted of a sorption colomn, a flow restrictor, and a tube leading to the ground surface. The device was lowered down a well, and the water-column pressure forced the sample through the cartridge. The apparatus lacked both a pumping unit and a packer. However, the end of the sampling tube was introduced directly into the ground water. This eliminated many of the problems which could have caused error in the previous sampler. This sampler was limited in its ability to obtain a time-averaged sample because of the lack of a programmable pumping unit and packer.

OBJECTS AND ADVANTAGES

Accordingly, several objects and advantages of my invention are to collect a time-averaged or composite sample of the chemical and biological parameters in ground waters. The sampling system is composed of four main components: well packer, packer tool, sampler, and sample sorption or membrane unit. The objects and advantages of each component will be discussed in order.

ADVANTAGES OF THE WELL PACKER: The sampling system provides for a pneumatically operated and controlled well packer which can be easily and accurately installed into wells with diameters of two inches or larger. The well packer is designed in such a manner that no air lines remain in the well casing after installation of the well packer. The well packer is installed and removed from the well casing using a simple packer tool designed specifically for this well packer. The main advantages of the well packer design are a reduction of cost and possible loss of air pressure through long air lines. Additionally, the air lines do not interfere with the insertion and removal of the sampler with the well packer. The well packer serves as a mounting platform for the sampler, prevents foreign matter from dropping into the well, and most importantly the well packer prevents the exchange of gases and volatile compounds between the ground water and the atmosphere. The volatilization of organic compounds is one of the major sources of error when sampling wells for volatile compounds. The packer, in conjunction with the sampler, prevents the volatilization of organic compounds and allows for the collection of a time-averaged sample which is representative of the true contamination of the aquifer. Currently, the standard procedure for sampling a well is to evacuate the well to remove all the water which may have been altered due to the well being left open to the atmosphere. A 40-mL or greater grab sample is then collected. Composite sampling or time-averaged sampling is not possible unless the well is closed to the atmosphere with a well packer or other capping method.

The well packer also prevents oxygen in the atmosphere from increasing the dissolved oxygen content of the water which may result in the oxidation/reduction of several chemical species encountered in ground waters.

ADVANTAGES OF THE PACKER TOOL: The packer tool allows for the easy and accurate installation of the well packer with a minimum amount of equipment. The tool is specifically designed to install and remove the well packer. The tool positions, inflates, deflates and removes the packer from the well casing with the use of only three pneumatic controls. The packer tool makes it possible to design well packers without dedicated air inflation line connecting the packer with the surface.

ADVANTAGES OF THE SAMPLER: The composite sampler is designed to collect a time-averaged sample in lieu of the 40-mL grab sample commonly used with Environmental Protection Agency methods. A composite sample is a more statistically valid indicator of the true mean of the population than is a grab sample. The sampler can be programmed to take a time-averaged sample from a period of time ranging from hours to months. Additionally, the sampler can be programmed to collect a sufficient quantity of sample on the sorption column to correspond with the most sensitive region of the ultimate analytical method used in analyzing the species (Gas Chromatography, Atomic Absorption, etc.). The sample is collected on a sorption column (i.e. ion exchange, activated charcoal, tenax, etc.) and therefore the transport of the sample is simpler and the possibility of volatilization losses are minimized over the transport of samples in 40-ml bottles. The sampler is designed so that the component holding the sorption column can be replaced with a component holding a semi-permeable membrane for the isolation of species of interest from the ground water. The isolated species can be analyzed by a variety of methods using sensor technology allowing for real-time analysis of ground-water contaminants. The primary advantages of real-time analysis of ground-water contaminants are more reliable detection of contaminants in the environment and a less costly method of monitoring these contaminants.

The composite sampler is designed to contain all the required pneumatic and electronic logic circuits. The electrical and air requirements of the sampler are modest enough that they can be contained within a two inch well casing. This allows the top of the well to be secured with no auxillary equipment needed outside the well casing.

Readers will find further advantages of the invention from a consideration of the ensuing description and accompanying drawings.

DESCRIPTION OF DRAWINGS

Drawing Figures

DESCRIPTION OF INVENTION

Figure 1:
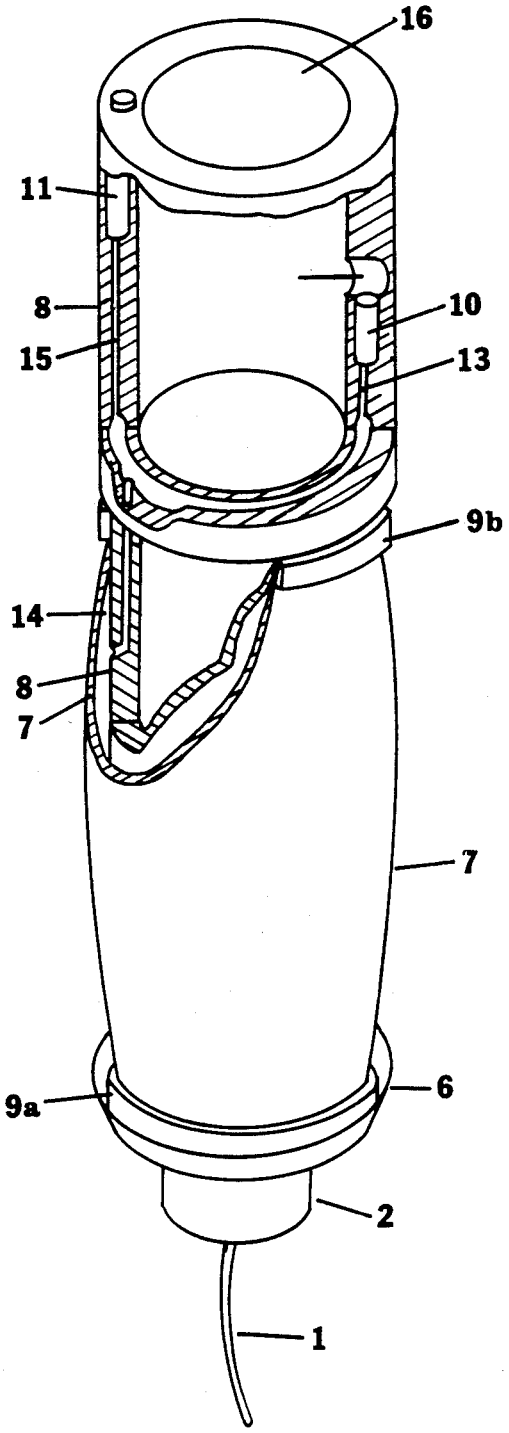
FIG. 1 shows well packer

FIG. 1 shows an overall view of the well packer component of the invention. The sample inlet tube 1 is a small diameter tube of variable lengths composed of a chemically inert material such a borosilicate glass or Teflon; Teflon is a trademark of E. I. duPont de Nemours & Co., Wilmington, DE. The sample inlet tube 1 is attached to the one-way inlet check valve body 2.

Figure 2:
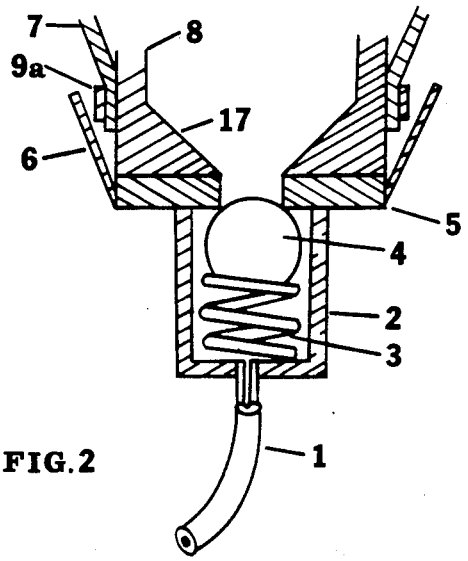
FIG. 2 shows cross-section view of check valve assembly

A cross section of the check valve body is illustrated in FIG. 2. The one-way inlet check valve body 2 is composed of Teflon. The one-way inlet check valve body 2 contains a spring 3 and Teflon or glass ball 4 which form the one-way inlet check valve assembly. The one-way inlet check valve body 2 is attached to the Teflon well packer body face plate 5. The one-way check valve assembly permits the passage of water from the sample inlet 1 to the sampler when the sampler is installed inside the well packer body tube 8. The well packer protection seal 6 is composed of Teflon and is attached to the well packer body face plate 5. The well packer protection seal 6 prevents the degradation of the rubber well packer inflation seal 7 by the ground-water contaminants. The rubber well packer inflation seal 7 is attached to the well packer body tube 8 using metal or plastic straps **9*a* and 9*b*. The Teflon well packer face plate 5 is attached to the well packer body tube 8**.

FIG. 1 illustrates the following features of the well packer. The well packer inflation valve 10 and well packer deflation valve 11 are located at the upper end and within the walls of the well packer body tube 8. The inflation inlet 12 connects the inside of the well packer body tube 8 with the entrance of the one-way inflation valve 10 located within the wall of the well packer body tube 8. The well packer inflation tube 13 runs from the exit of the one-way inflation valve 10 to the well packer inflation space 14. The well packer inflation space 14 is the area defined between the packer body tube 8 and the rubber packer inflation seal 7. The well packer deflation tube 15 is the tube which runs from well packer inflation space 14 to the entrance of the one-way deflation valve 11 located within the wall of the well packer body tube 8. The ground-water sampling component enters the sampler entrance orifice 16 located at the top of the well packer body tube 8. The sampler when inserted into the well packer component rests on the sampler check valve seat 17, see FIG. 2. The sampler check valve seat 17 is mounted to the top side of the well packer body face plate 5.

Figure 3:
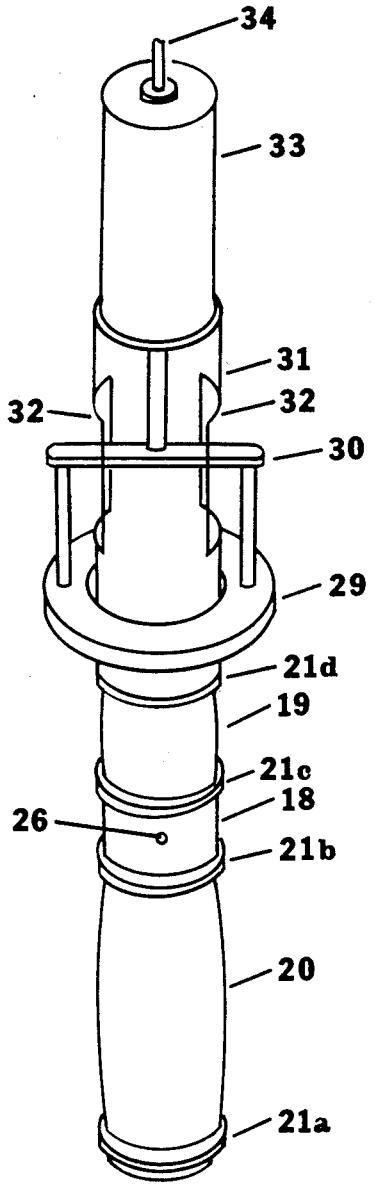
FIG. 3 shows packer tool

FIG. 3 illustrates the packer tool. The packer tool body 18 is designed to have a smaller outside diameter than the inside diameter of the well packer tube body 8. The upper packer tool inflation seal 19 and the lower packer tool inflation seal 20 are attached to the packer tool body 18 with metal or plastic straps **21*a,b,c* and *d*. The upper and lower packer tool inflation seals 19,20** are composed of a flexible rubber which are easily inflated by air pressure.

Figure 4:
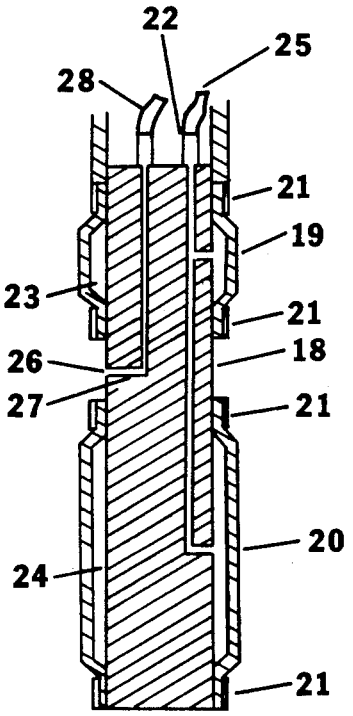
FIG. 4 shows cross-section of packer tool body

FIG. 4 illustrates the cross section of the packer tool body. The packer tool inflation tube 21 is located inside the packer tool body 18 and links the packer tool inflation inlet 22 with the upper and lower packer tool inflation spaces 23,24. The upper and lower packer tool inflation spaces 23,24 are the spaces defined between the packer tool body 18 and the upper and lower packer tool inflation seals 19,20, respectively. The packer tool inflation supply line 25 connects to the packer tool inflation inlet 22 with the the control panel at the surface.

The upper and lower packer tool inflation seals 19,20 are located on the packer tool body 18 in such a manner the seals isolate the inflation inlet 12 located on the inner wall of the well packer body tube 8. The packer inflation outlet 26 located on the packer tool body 18 is then able to transfer pressurized air from the packer tool to the well packer through the well packer inlet 12. The packer inflation tube 27 connects the packer inflation outlet 26 with packer inflation supply line 28. The packer inflation supply line 28 connects the packer inflation tube 27 with the control panel at the surface.

FIG. 3 illustrates the remaining features of the packer tool. The valve release ring 29 is attached to the valve release body 31 using the valve release bar 30. The valve release bar 30 is free to travel in the two slots 32 which are located opposite of each other on the valve release body 31. The valve release cylinder 33 is securely attached on the top of valve release body 31. The stroke rod of the cylinder is attached to the valve release bar 30. The vertical movement of the cylinder stroke rod causes the valve release bar 30 and valve release ring 29 to move up and down in the slots 32 located in the walls of the valve release body 31. The valve release body 31 is securely attached to the packer tool body 18. The valve release cylinder supply line 34 connects the valve release cylinder 33 with the control panel located on the surface.

Figure 5:
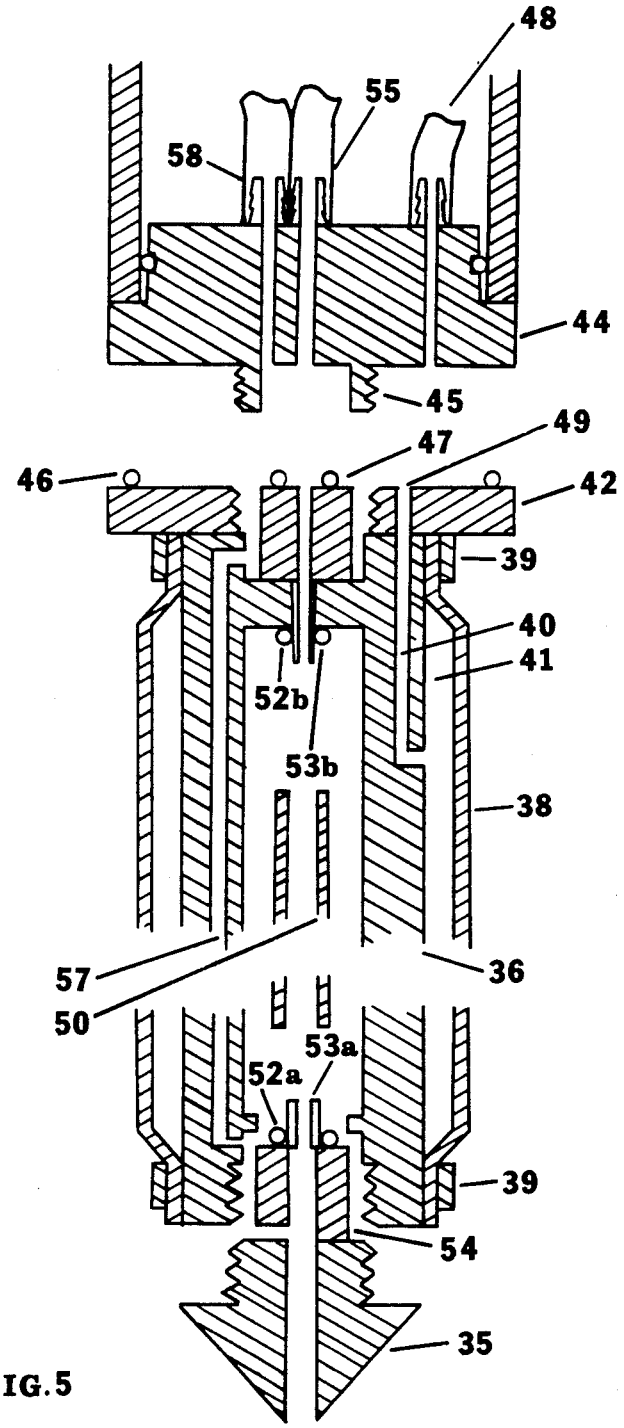
FIG. 5 shows cross-section of lower part of sampler and sorption unit

FIG. 5 illustrates the cross section view of the lower part of the sampler and the sorption tube. The description will begin from the bottom of the sorption tube. The check valve opening tip 35 is made of Teflon and is the terminus of the sorption column cartridge holder 36. In the alternative, the sorption cartridge holder 36 may be replaced with a tube fitted with a semi-permeable membrane for the separation of the species of interest from the ground water.

The rubber sampler inflation seal 38 is attached to the sorption column cartridge holder 36 using metal or plastic straps **39*a* and 39*b*. The air inflation tube 40 connects the air inflation space 41 with the interface space 49 between the cartridge column holder top plate 42 and the sampler bottom plate 44. The air inflation space 41 is the space defined between the rubber sampler inflation seal 38 and the sorption column cartridge holder 36. The sorption column cartridge holder 36 is connected to the sampler bottom plate 44 using pipe fitting 45. The sorption column cartridge holder 36 is screwed onto the pipe fitting 45 until the o-ring 46 is compressed firmly between the sampler bottom plate 44 and the cartridge holder top plate 42. The region between the sampler bottom plate 44 and the cartridge holder top plate 42 is labelled the interface space 49. The inflation/deflation supply line 48 connects to the interface space 49 through the sampler bottom plate 44**.

The glass sorption column 50 with Teflon caps 51 is compressed between a pair of o-rings **52*a* and 52*b* mounted on needles 53*a* and 53*b*. The lower needle 53*a* and o-ring 52*a* are mounted on a one-way check valve 54 which allows flow only in an upward direction. The pressure required to keep the o-rings 52*a* and 52*b* pressed tightly against the glass sorption column 50 is applied by the screwing of the check valve opening tip 35 into the female treads located on the inside of the sorption cartridge holder 36. The upper needle 53*b* and o-ring 52*b* are mounted on a constriction on the inside of the sorption column cartridge holder 36. The hollow upper needle 53*b* connects to the entrance of a one-way check valve 47 orientated to pass water in only an upward direction. The top of the one-way check valve 47 is designed to seat firmly to the sampler bottom plate 44 when the sorption column cartridge holder 36 is screwed onto the pipe fitting 45. This allows water to flow from the needle 53*a* to the column outlet fitting 55. The column outlet fitting 55 is connected to a normally open port of a three-way valve 56*a***.

The inlet of the bypass line 57 is connected just below the one-way check valve 54 and runs parallel to the sorption column through the body of the sorption column cartridge holder 36. The bypass line 57 exits into the space defined between the cartridge holder top plate 44 and the one-way check valve 47. The flow can pass from this space through the sampler bottom plate 44 to the bypass line fitting 58. The bypass fitting 58 is connected to the normally closed port of the three-way check valve 56 which in turn is connected to the bottom of the one-way pumping check valve 59. Fittings 45, 55 and 58 as well as valve 47 are shown in the bottom view of FIG. 8.

Figure 6:
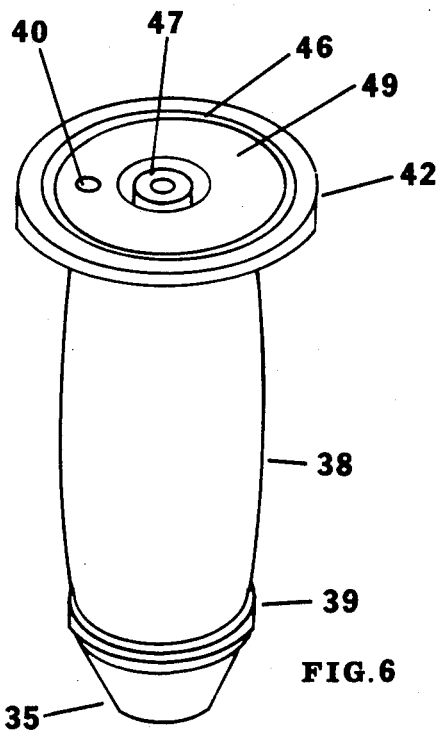
FIG. 6 shows outside view of sorption unit

FIG. 6 illustrates the outside view of the sorption column cartridge holder and the exterior features.

Figures 7, 8:
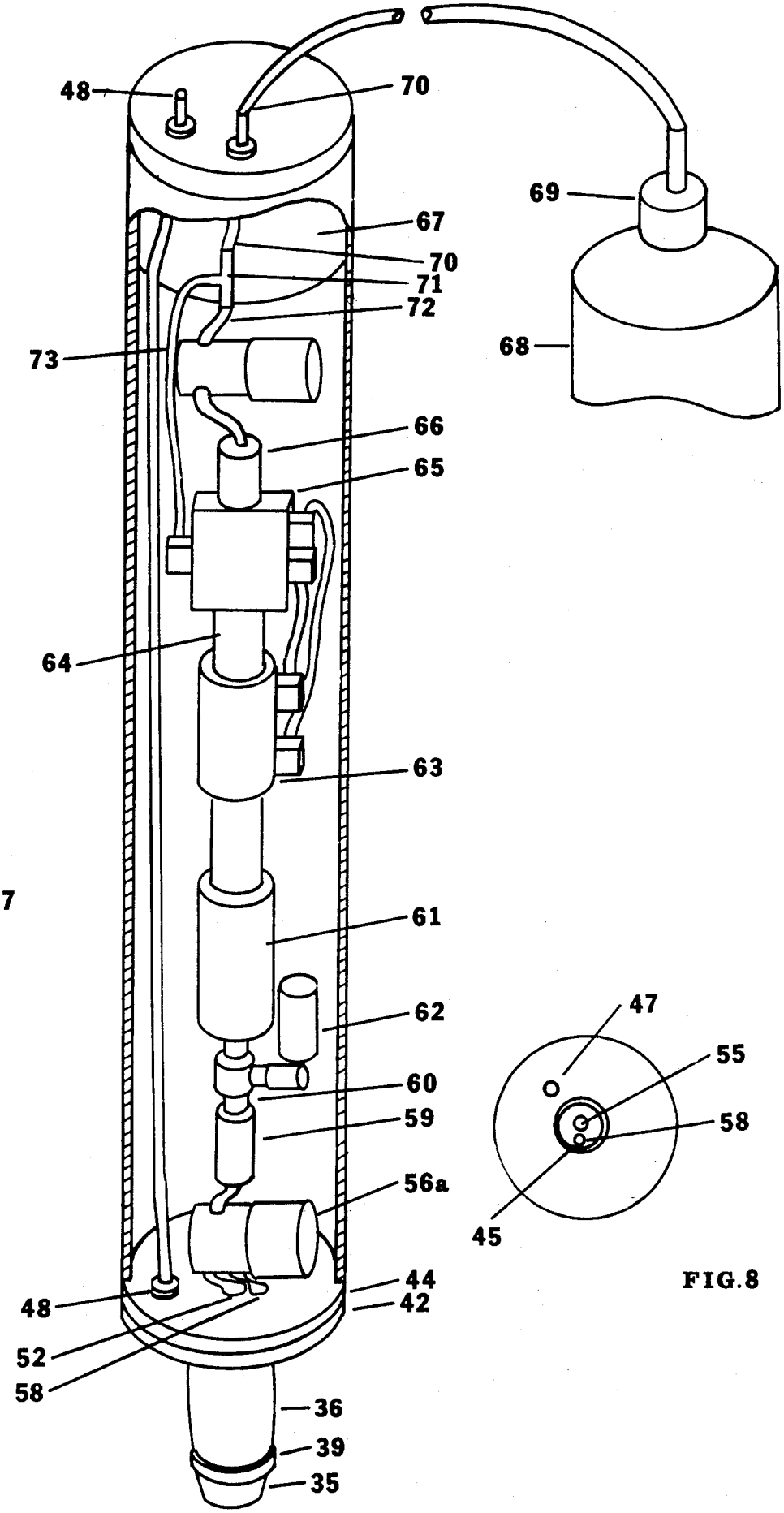
FIG. 7 shows sampler unit
FIG. 8 shows bottom view of sampler

FIG. 7 illustrates the overall view of the sampler with the sorption column component attached. This description will begin at the bottom of the apparatus. The sorption column cartridge holder 36 is connected to the sampler body by the firm attachment of the cartridge holder top plate 42 to the sampler bottom plate 44, see the above discussion for the details of this attachment. The column outlet fitting 55 is connected to a normally open port of a three-way valve 56. The bypass fitting 58 is connected to the normally closed port of the three-way check valve 56. The common port of the three-way valve 56 is connected to the bottom of the pumping check valve 59. The top of the pumping check valve 59 is connected to a T-fitting 60. The other two ports of the T-fitting 60 are connected to the bottom of the pumping cylinder 61 and to the water discharge one-way check valve 62. The water discharge one-way check valve 62 is connected to pass flow only upwards. The upper stroke rod of cylinder 61 is connected to the lower stroke rod of cylinder 63. Cylinder 63 is pneumatically operated while cylinder 61 is only used for its pumping action. Cylinder 63 drives the pumping action of cylinder 61. The spacer 64 connects the top of cylinder 63 with a four-way air valve 65. The length of spacer 64 is the distance required for the upper stroke rod of cylinder 63 to reset or make contact with the switch on the bottom of the four-way check valve 65. The top of the four-way valve 65 is connected to electrically controlled pressure diaphragm 66. The pressure diaphragm 66 resets the top switch of the four-way valve 65. The electrical connections to the electrically controlled pressure diaphragm 66 and the three-way valve 56 are controlled by the electronic logic circuits 67.

The air pressure required to operate the pneumatic system originates from the compressed air cylinder 68. The outer diameter of the air cylinder 68 is selected to be less than the inner diameter of the well casing. A pressure regulator 69 is placed in the orifice of the air cylinder 68 with an air supply line 70 being connected to a T-fitting 71. The two pressure lines 72,73 which run from the T-fitting 71 are connected to the entrance of the four-way valve 65 and the air supply port on the electrically operated diaphragm 66.

The inflation/deflation supply line 48 which controls the pressure behind the rubber sampler inflation seal 38 runs to the surface where it connected to a control panel of the user.

OPERATION OF INVENTION

OPERATION OF THE WELL PACKER AND PACKER TOOL (INSTALLATION OF THE WELL PACKER): The well packer of FIG. 1 is installed and removed from the well using packer tool of FIG. 3. The user at the surface places the packer tool body 18 inside the well packer body 8. The packer tool inflation supply line 25 is pressurized to 20–40 psi and the upper and lower packer tool inflation seals 19,20 inflate pressing firmly against the inside wall of the well packer body wall 8. The well packer and packer tool maybe lowered to the desired depth by the use of a cable composed of the valve release supply line 34, packer inflation supply line 28 and packer tool inflation supply line 25. Once the desired depth is reached the packer inflation supply line 28 is pressurized. The pressure is transmitted through the packer inflation tube 27 to the packer inflation outlet 26. The pressure is then transferred from the packer inflation outlet on the packer tool body 18 to the inflation inlet 12 located on the inside wall of the well packer body 8. The pressure is transferred from the packer tool to the well packer inflation inlet 12 because of the seals formed by the upper and lower packer tool inflation seals 19,20.

The air pressure is transferred through the the one-way inflation valve 10 through the well packer inflation tube 13 and into the well packer seal inflation space 14. The pressure inflates the rubber packer inflation seal 7 which locks the packer tightly into the well casing. The packer inflation supply line 28 is then depressurized and the one-way inflation valve 10 retains the pressure within the packer. The packer tool inflation supply line 25 can be depressurized and the packer tool removed from the inside of the packer body 8 and the well casing. After this operation the packer is firmly positioned in the well casing and ready to accept the sampler.

OPERATION OF THE WELL PACKER AND PACKER TOOL (REMOVAL OF THE WELL PACKER): The well packer is removed from the well using the following procedures. The packer tool is lowered into the well until the packer tool body 18 is positioned inside the well packer body 8. The packer tool inflation line 25 is pressurized which inflates the upper and lower packer tool inflation seals 19,20. The inflation of these seals firmly secures the packer tool body 18 inside the packer body 8. The valve release cylinder supply line 34 is pressurized causing the valve release bar 30 and valve release ring 29 to be forced down to touch the pressure release switch on the one-way deflation valve 11. The air pressure contained in the packer seal inflation space 14 is vented through the packer inflation tube 15 to the atmosphere through the opened one-way deflation valve 11. The deflation of the rubber packer well inflation seal 7 allows the well packer to be removed easily from the well casing by pulling up on the cable of the packer tool.

INSTALLATION OF SAMPLER: The sampler illustrated in FIG. 7 is installed into the well by lowering the sampler on a cable until check valve opening tip 35 on the sampler pushes down on ball 4 and spring 3 of the check valve assembly on the well packer, see FIG. 2. The inflation/deflation supply line 48 is pressurized with 20–40 psi. The air pressure passes through the inflation/deflation fitting 47, the interface space 49 and air inflation tube 40, and inflates the rubber sampler inflation seal 38. The rubber sampler inflation seal when inflated presses firmly on the inside wall of the well packer body 8 thereby anchoring the sampler. After these operations the sampler is ready to take samples.

OPERATION OF THE SAMPLER: The user would use the following procedure for the operation of the sampler. The entire sampling procedure is controlled by the electronic logic circuits 67, while the power needed to pump the water through the sampler is supplied from a pressurized air supply 68. Once the sampler is attached to the well packer and the ball 4 and spring 3 of the check valve assembly of the well packer is open, the ground water is free to flow into the check valve opening tip 35 of the sampler. The electronic logic circuit activates the solenoid of the normally closed three-way valve 56 permitting the water to be pumped from the Teflon tube 1 of the well packer through the check valve assembly into the check valve opening tip 35 on the sampler. The water is directed through the bypass line 57 to the three-way valve and into the pumping assembly. This is the flushing cycle to clear the well packer of stagnant water. After one or more flushing cycles, the electronic logic circuit 67 deactivates the solenoid placing the three-way valve 56 in its normally open configuration. The water flow is now directed through the one-way check valve 54 and through the sorption column 50. This is the sampling cycle. The contaminants of interest are now retained on the column and the water flow directed through the three-way valve 56 and into the pumping assembly.

The pumping assembly is also controlled by the electronic logic circuit 67 and each time a logic signal is sent to the three-way valve 56 to determine whether a flushing or sampling cycle will be accomplished, a logic signal starts the pumping action. The logic signal activates the electronically controlled pressure diaphragm 66 which resets the four-way valve 65 and causing the air pressure from the compressed air cylinder 68 to flow to air cylinder 63. The pressure causes the stroke rod of cylinder 63 to rise and because the lower stroke rod of cylinder 63 is connected to the upper stroke rod of cylinder 61 the upward movement of cylinder 63 causes a similar motion in cylinder 61. As the lower stroke rod of cylinder 63 goes up, water enters through the pumping check valve 59 and into the vacuum caused by the receding of the stroke rod of cylinder 61. Both cylinders 61,63 continue to rise until the upper stroke rod of cylinder 63 touches the lower switch of the four-way check valve 65. The four-way air valve switches the direction of the air pressure to cylinder 63 forcing the stroke rod down. The forcing of the stroke rod of cylinder 63 also forces the stroke rod of cylinder 61 down. This forces the water which was introduced into cylinder 61 out through the pumping valve 62. The pumping cycle can not begin again until a logic signal from the electronic logic circuit 67 is sent to the electrically controlled pressure diaphragm 66.

The timing of the pumping action can be programmed into the logic circuit so that a time-averaged or composite sample can be taken over any desired period of time.

CONCLUSION AND SCOPE OF INVENTION

The reader will observe the ground-water sampling system addresses most of the problems commonly associated with sampling ground water for species which can interact with the atmosphere. The system has been designed to fit totally within the well casing allowing it to be free from disturbances which plague systems not designed in this manner. The ability of the system to sample in a time-averaging mode will improve both the sensitivity and the precision of the sample collected. Most importantly the system permits the sorption unit to be replaced by different chemical or physical analyzing modules for the potential of performing real-time analysis.

While my above description contains many specificities, these should not be construed as limitations on the scope of the inventions, but rather as an exemplification of one preferred embodiment thereof. For example, the pnuematic pumping system can be replaced with an electrical pumping system if such a configuration is preferred for other reasons. The system may be serviced from electrical and air supplies from outside the well if circumstances favor such a configuration. The pumping system outlined in the description of the invention contains one-way check valves. Diaphragm, peristaltic, bladder and piston type pumps could also be used. The well packer may be serviced by dedicated inflation and deflation lines instead of using the packer tool. The one-way check valve assembly located at the bottom of the well packer can be replaced with an assembly which opens after inflating the rubber seal on the sorption column cartridge holder.

Accordingly, the scope of the invention should be determined by the appended claims and their legal equivalents.

We claim:

1. In a well casing, a ground water sampling system comprising:

a. a pumping unit, b. a sorption column and physical or chemical cell mounted under said pumping unit for analyzing different chemical parameters, and c. a packer used to mount said pumping unit and sorption column and physical or physical cell in a well casing, whereby said packer provides a means of preventing exchange of gases between atmosphere and ground water.

2. The ground water sampling system of claim 1 wherein said pumping unit is totally self-contained within the well casing.

3. The ground water sampling system of claim 1 wherein said pumping unit is pneumatically operated with electrical controls.

4. The ground water sampling system of claim 1 wherein said sorption column and physical or chemical cell is mounted to said packer using an inflatable seal.

* * * * *